US011566411B2

(12) United States Patent
Schorstein

(10) Patent No.: US 11,566,411 B2
(45) Date of Patent: Jan. 31, 2023

(54) STORM WATER AND TRAFFIC COLLECTOR BOX CULVERT

(71) Applicant: Alexander B. Schorstein, Lawrenceville, GA (US)

(72) Inventor: Alexander B. Schorstein, Lawrenceville, GA (US)

( * ) Notice: Subject to any disclaimer, the term of this patent is extended or adjusted under 35 U.S.C. 154(b) by 0 days.

(21) Appl. No.: 17/712,994

(22) Filed: Apr. 4, 2022

(65) Prior Publication Data

US 2022/0372743 A1 Nov. 24, 2022

Related U.S. Application Data

(60) Provisional application No. 63/191,894, filed on May 21, 2021.

(51) Int. Cl.

| | |
|---|---|
| ***E03F 1/00*** | (2006.01) |
| ***E03F 5/14*** | (2006.01) |
| ***E01F 5/00*** | (2006.01) |
| ***E03F 5/04*** | (2006.01) |
| ***E01C 11/22*** | (2006.01) |

(52) U.S. Cl.

CPC ..... *E03F 1/005* (2013.01); *E01C 11/224* (2013.01); *E01C 11/227* (2013.01); *E01F 5/005* (2013.01); *E03F 5/0404* (2013.01); *E03F 5/14* (2013.01)

(58) Field of Classification Search

CPC . E03F 1/00; E03F 1/005; E03F 5/0401; E03F 5/0404; E03F 5/14; E01F 5/00; E01F 5/005; E01C 5/085; E01C 11/223; E01C 11/224; E01C 11/225; E01C 11/227

USPC ..... 210/163, 164, 170.03, 747.2, 747.3; 404/2, 4; 405/124, 125, 126

See application file for complete search history.

(56) References Cited

U.S. PATENT DOCUMENTS

| | | | | |
|---|---|---|---|---|
| 1,860,533 A | | 5/1932 | Fredenhagen | |
| 1,870,156 A | * | 8/1932 | Wheeler | E01F 5/005 210/164 |
| 4,365,911 A | | 12/1982 | Rossberg | |
| 4,815,895 A | | 3/1989 | Purssey et al. | |

(Continued)

FOREIGN PATENT DOCUMENTS

| | | |
|---|---|---|
| CN | 106869174 A | 6/2017 |
| CN | 210066480 U | 2/2020 |

(Continued)

OTHER PUBLICATIONS

Box Culverts—Foley Products website: https://www.foleyproducts.com/precast-pipe-products/box-culverts/, 4 pgs. (retrieved: Apr. 4, 2022).

(Continued)

*Primary Examiner* — Christopher Upton

(74) *Attorney, Agent, or Firm* — Bekiares Eliezer LLP

(57) ABSTRACT

Disclosed in the present application is a system for a storm water and traffic collector box culvert. The system may comprise a plurality of reinforced slabs with an upper slab that may be configured as a reinforced surface to collect storm water runoff. The plurality of slabs may be connected by a plurality of attachment mechanisms. Accordingly, the present system is directed to an environmentally friendly culvert design that can minimize the magnitude of earthworks required by traditional drainage systems while also providing increased drainage capabilities.

19 Claims, 8 Drawing Sheets

(56) References Cited

U.S. PATENT DOCUMENTS

| | | | | |
|---|---|---|---|---|
| 4,983,070 | A * | 1/1991 | Hwang | E01F 5/005 405/124 |
| 5,380,121 | A | 1/1995 | Schluter | |
| 6,941,703 | B2 | 9/2005 | MacLean et al. | |
| 7,530,764 | B1 | 5/2009 | Gallegos | |
| 2007/0181197 | A1* | 8/2007 | Krichten | E03F 1/005 137/833 |
| 2010/0226721 | A1* | 9/2010 | May | E01F 5/00 405/126 |
| 2015/0151914 | A1* | 6/2015 | Boulton | E03F 1/005 210/170.03 |
| 2016/0116112 | A1* | 4/2016 | Bradfield | E03F 1/005 405/126 |
| 2019/0357521 | A1 | 11/2019 | Duerloo | |

FOREIGN PATENT DOCUMENTS

| | | | |
|---|---|---|---|
| CN | 210140780 | U | 3/2020 |
| CN | 210195817 | U | 3/2020 |
| CN | 211446449 | U | 9/2020 |
| CN | 212247917 | U | 12/2020 |
| EP | 1522638 | A1 | 4/2005 |
| FR | 2713254 | * | 6/1995 |
| KR | 200277616 | | 6/2002 |
| KR | 200314039 | Y1 | 5/2003 |
| KR | 100570462 | B1 | 4/2006 |
| KR | 100738590 | B1 | 7/2007 |
| KR | 101174413 | B1 | 8/2012 |

OTHER PUBLICATIONS

Jensen Precast—Box Culverts—Segmental Box Culvert website: https://www.jensenprecast.com/Box-Culverts/Segmental-Box-Culvert-p15600/, 15 pgs. (retrieved: Apr. 4, 2022).

A&R Concrete Products—Trench Drains—website: http://arconcrete.com, 4 pgs. (retrieved: Apr. 4, 2022).

International Search Report and Written Opinion dated Jul. 12, 2022 cited in Application No. PCT/US22/23355, 12 pgs.

* cited by examiner

STORM WATER AND TRAFFIC COLLECTOR BOX CULVERT

RELATED APPLICATION

Under provisions of 35 U.S.C. § 119(e), the Applicant claims benefit of U.S. Provisional Application No. 63/191,894 filed on May 21, 2021, which is incorporated herein by reference in its entirety.

It is intended that the referenced application may be applicable to the concepts and embodiments disclosed herein, even if such concepts and embodiments are disclosed in the referenced application with different limitations and configurations and described using different examples and terminology.

FIELD OF DISCLOSURE

The present disclosure generally relates to the field of environmentally friendly urban infrastructure storm water runoff management.

BACKGROUND

In many situations, urban infrastructure can negatively impact the living environment. For example, most modern infrastructure merely sits on top of the soil where the infrastructure is constructed. This continuously expanding soil covering can kill the surrounding natural environment. Without the runoff protection, offered by the natural environment, urban areas require expansive systems to compensate for the runoff associated with urban development. Thus, the conventional strategy is to design winding drainage systems, that while effective for capturing runoff, may become easily clogged due to the shape of the drainage system. Therefore, even minor rainstorms can turn into manmade floods that can lead to increased soil erosion and contamination of water and soil in the living environment. The extensive soil coverage in urban areas increases the need for these areas to rely more heavily on culverts and drainage systems.

BRIEF OVERVIEW

This brief overview is provided to introduce a selection of concepts in a simplified form that are further described below in the Detailed Description. This brief overview is not intended to identify key features or essential features of the claimed subject matter. Nor is this brief overview intended to be used to limit the claimed subject matter's scope.

Disclosed is a system for a storm water and traffic collector box culvert for both allowing traffic (e.g., automobile, pedestrian, bicycle, and/or other traffic) to flow across an upper surface, and collecting storm water runoff and allowing the runoff to drain and flow through a lower portion, below the upper surface. The system may be modular, and each module may include an upper slab that may be constructed with a reinforced road surface, a plurality of grated cages for allowing runoff to drain away from the upper surface through a plurality of corresponding drainage mechanisms, while preventing the traffic from being impeded by the drainage mechanisms, and a plurality of attachment mechanisms for attaching the module to other modules in the system. The reinforced road surface may be sloped to direct the runoff towards the plurality of grated cages. The plurality of drainage mechanisms may be configured to drain the runoff, collected by the reinforced road surface. The plurality of attachment mechanisms may be configured to connect the module to at least one additional module to create a desired angle (e.g., 45°, 60°, 90°) between the upper slab of the module and the upper slab of the at least one additional module. In some embodiments of the present disclosure, a base slab may be disposed below the upper slab to collect the runoff that drains through the drainage mechanisms. The base slab may comprise a plurality attachment mechanisms, configured to connect the base slab of the module to a base slab of at least one additional module to create a desired angle between the base slab of the module and the base slab of the at least one additional module.

Additionally, the system may comprise a first side wall and a second side wall. The first side wall and the second side wall may each comprise a plurality of attachment mechanisms to secure to the upper slab to the base slab and create a desired angle between the upper slab and the base slab. Additionally, the system may comprise a center support mechanism comprising a plurality of vertical support columns. The plurality of vertical support columns may be configured to attach to the upper slab and the base slab. In some embodiments, the center support mechanism may further comprise two beams disposed along the upper slab and the base slab respectively, with the plurality of vertical support columns spaced evenly between the two beams.

Both the foregoing brief overview and the following detailed description provide examples and are explanatory only. Accordingly, the foregoing brief overview and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicant. In addition, the drawings may contain other marks owned by third parties and are being used for illustrative purposes only. All rights to various trademarks and copyrights represented herein, except those belonging to their respective owners, are vested in and the property of the Applicant. The Applicant retains and reserves all rights in its trademarks and copyrights included herein, and grants permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure. In the drawings.

DETAILED DESCRIPTION

Figure 1:
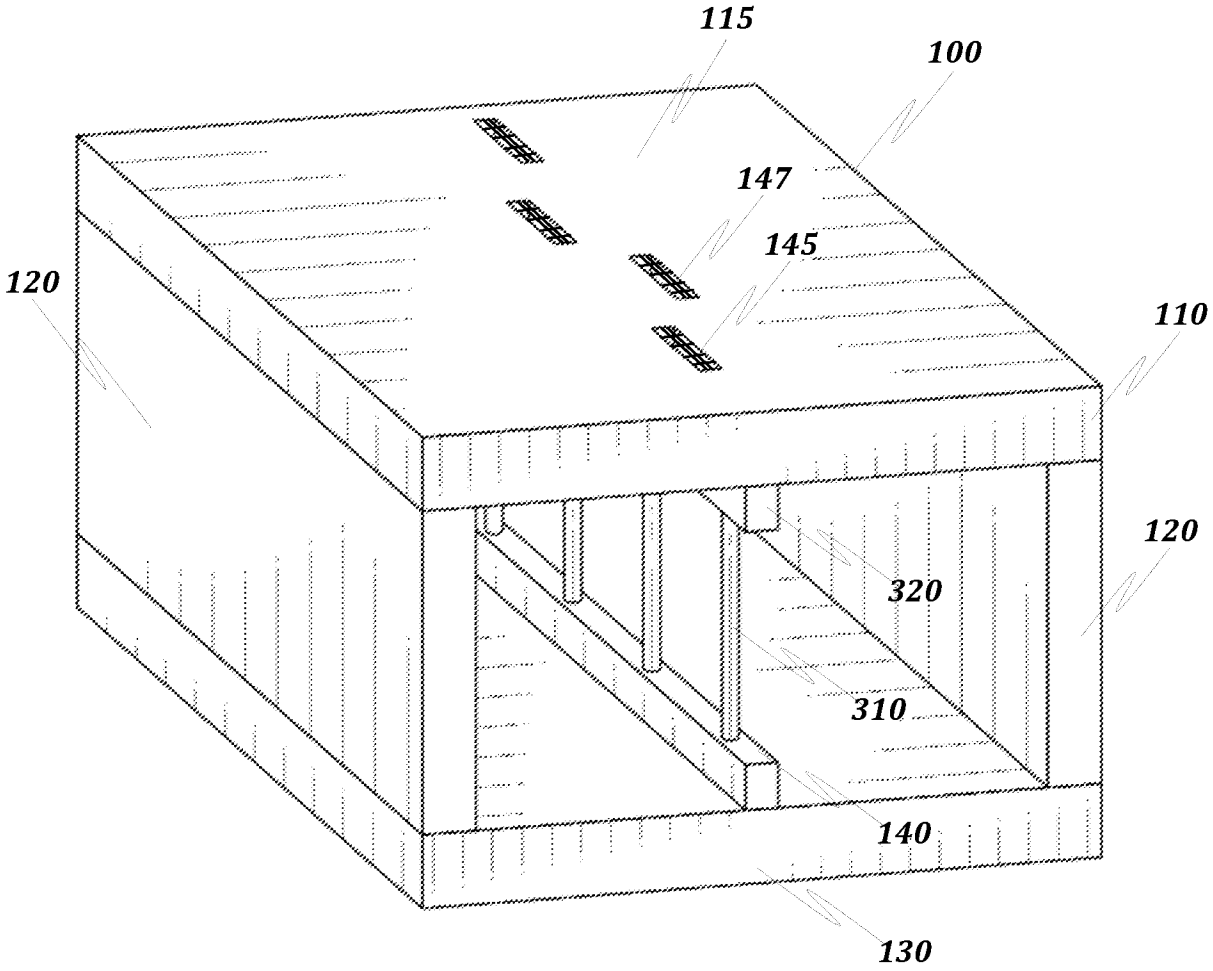
FIG. 1 is a perspective view of a Storm Water and Traffic Collector Box Culvert in an assembled state.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Regarding applicability of 35 U.S.C. § 112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

The present disclosure includes many aspects and features. Moreover, while many aspects and features relate to, and are described in, the context of Storm Water and Traffic Collector Box Culverts, embodiments of the present disclosure are not limited to use only in this context.

I. SYSTEM OVERVIEW

This overview is provided to introduce a selection of concepts in a simplified form that are further described below. This overview is not intended to identify key features or essential features of the claimed subject matter. Nor is this overview intended to be used to limit the claimed subject matter's scope.

Embodiments of the present disclosure relate to a Storm Water and Traffic Collector Box Culvert system. For example, the system may comprise a plurality concrete slabs that would allow for storm water runoff to flow under a road, railroad, trail, or other path. While culverts are traditionally buried and installed as a different system from the path, embodiments of the present disclosure related to a system comprising one or more culverts integrated with an upper slab configured to drain runoff towards a plurality of drainage mechanisms to allow for the system of the present disclosure to collect the drained runoff into the culvert and integrates a road surface on the upper slab of the culvert. Accordingly, the road surface of the upper slab of the system with the combined ability for the enclosed volume of the culvert to capture storm water runoff provides a less environmentally impactful drainage system.

For example, the storm water and traffic collector box culvert may be integrated into existing urban infrastructure. By applying the system to current roads and/or interconnecting the system with existing storm drains, the culvert system disclosed in the application may provide additional centralized drainage capacity to existing urban drainage systems. The upper surface of the system may be configured with a road surface to allow for traffic flow, minimizing changes to traffic patterns while providing the additional drainage capacity. The road surface of the system may have a slight reversed crown to direct runoff towards a plurality of drainage mechanisms disposed along a central portion of the road surface. For example, the drainage mechanisms may provide a continuous means to collect runoff in the system. In some embodiments of the present disclosure, the system may provide the area surrounding the system with a cooling effect caused by the collected runoff interfacing with the air enclosed in the culvert to reduce the urban heat bubble.

In some embodiments of the present disclosure the system may require less earthworks to install than traditional drainage systems. Further, by configuring a road surface on the upper slab of the system, there would be less total disturbance to the environment than traditional drainage systems.

Embodiments of the present disclosure may comprise methods, systems, and components comprising a plurality of reinforced slabs.

A. A Plurality of Reinforced Concrete Slabs

B. A Plurality of Attachment Mechanisms

Details with regards to each component are provided below. Although components are disclosed with specific functionality, it should be understood that functionality may be shared between components, with some functions split between components, while other functions duplicated by the components. Furthermore, the name of the component should not be construed as limiting upon the functionality of the component. Moreover, each stage disclosed within each component can be considered independently without the context of the other stages within the same component or different components. Each stage may contain language defined in other portions of this specifications. Each stage disclosed for one component may be mixed with the operational stages of another component. In the present disclosure, each stage can be claimed on its own and/or interchangeably with other stages of other components.

Both the foregoing overview and the following detailed description provide examples and are explanatory only. Accordingly, the foregoing overview and the following detailed description should not be considered to be restrictive. Further, features or variations may be provided in addition to those set forth herein. For example, embodiments may be directed to various feature combinations and subcombinations described in the detailed description.

II. SYSTEM CONFIGURATION

Embodiments of the present disclosure provide a storm water and traffic collector box culvert. The system may be configured to collect runoff from a road surface that may be integrated into the construction of the system. Accordingly, embodiments of the present disclosure provide a storm water and traffic collector box culvert.

FIG. 1 illustrates one potential embodiment of the storm water and traffic collector box culvert system 100 in the assembled orientation consistent with an embodiment of the disclosure for providing the system. The assembled culvert 100 may comprise a plurality of slabs. In one embodiment the plurality of slabs may comprise an upper slab 110, a plurality of side walls 120, and a base slab 130. The system 100 may further comprise a center support mechanism 140. In embodiments, one or more (e.g., each) of the plurality of slabs may be formed from a concrete material, and may be constructed using one or more of a plurality of different reinforcing materials such as metals, plastics, ceramic materials, or other materials that can provide structural support to the plurality of slabs. Further the plurality of slabs may be interconnected using a plurality of attachment mechanisms 150 to secure the system 100 in a desired orientation.

Additionally, when the culvert 100 is assembled, the upper slab 110 of the system may be configured as a road surface. In embodiments, the upper slab may have dimensions sufficient to allow for an automobile (e.g., a car or truck) to be disposed thereon. For example, the upper slab 110 may have a top surface that is 20 feet by 10 feet, that may be suitable for the parking aisle. However, those of skill in the art will recognize that larger and/or smaller dimensions are possible without departing from the scope of the invention. The upper slab 110 may include a plurality of drain mechanisms 145 distributed on or around a centerline of the upper slab 110. In some embodiments of the present disclosure, the plurality of drains may comprise a grate 147. When the system 100 is assembled, the upper slab 110 is separated from the base slab 130 by the side walls 120, defining a volume of the system. The volume of the system 100 may allow runoff collected by the plurality of drainage mechanisms 145 on the upper slab 110 to accumulate within the defined volume, contained by the upper slab 110, the base slab 130, and the side walls 120. For example, the drainage mechanism 145 may include drains, grates, and/or pipes for transferring runoff (e.g., storm water) from the upper slab 110 into a culvert formed by the upper slab 110, the base slab 130, and the side walls 120. In further embodiments of the present disclosure, the assembled system 100 may allow some runoff to seep between slabs, particularly where the slabs are interconnecting. In particular, the seepage rate may be controlled, such that the seepage rate allows the surrounding environment may absorb the runoff (e.g. 0.5-5 cm absorbed each hour for loam, at least 5 cm each hour absorbed by more sandy soil). In some embodiments, the upper slab 110 may be configured with a slight reversed crown to direct water towards the center line of the upper slab. The plurality of drains 145 may be positioned at or near the center line to allow the water to drain from the upper slab. As an example, the upper slab 110 may be sloped about 0.5-1% towards the centerline of the upper slab 110, though greater or lesser reversed crown slopes are contemplated.

In some embodiments of the present disclosure, the upper slab 110 may comprise a reinforced surface 115. The reinforced surface 115 may comprise roads for cars, bikes, foot traffic, and/or other transportation paths. For example, the upper slab 110 may comprise a plurality of reinforced surfaces 115, such as a street and/or a sidewalk. Accordingly, the plurality of drainage mechanisms 145 may be distributed throughout the upper slab 110 according to the environment where the system 100 is being used. The reinforced surface 115 may be reinforced such that it is suitable for automobiles (e.g., cars, trucks, etc.) to travel and/or park thereon. In some embodiments, the reinforced surface 115 may have a slight reversed crown or slope towards the plurality of drainage mechanisms. In some embodiments, each reinforced surface 115 may include a plurality of drainage mechanisms 145. In other embodiments, the plurality of drainage mechanisms 145 may be shared among all reinforced surfaces 145 on the upper slab 110.

Figure 2:
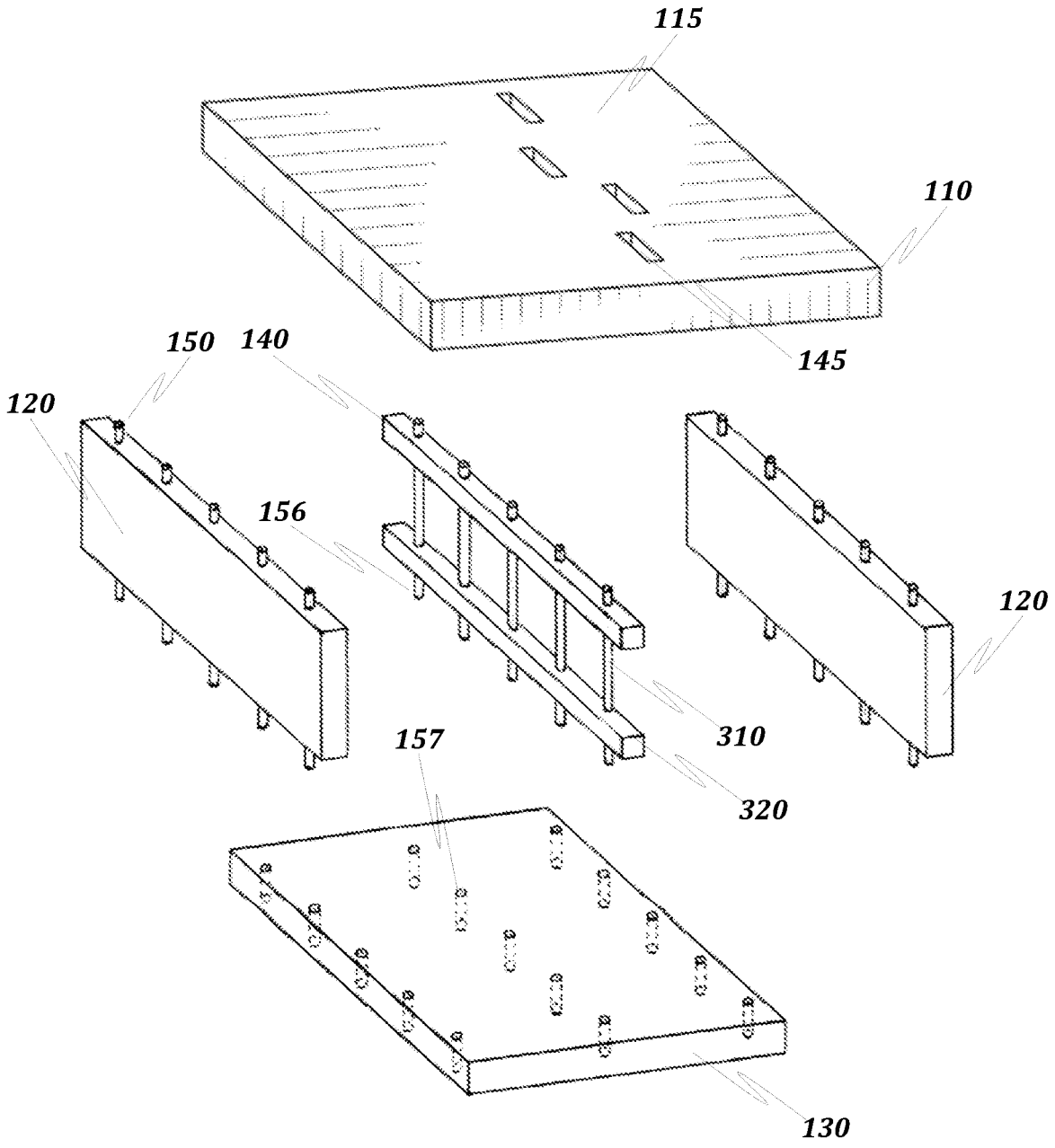
FIG. 2 is a component view of the Storm Water and Traffic Collector Box Culvert.

FIG. 2 illustrates an exploded component view of the system 100, depicting some components that form the system. In particular, FIG. 2 illustrates the plurality of side walls 120, the base slab 130, and the center support mechanism 140. As illustrated in FIG. 2, the plurality of attachment mechanisms 150 may enable the plurality of slabs to interconnect. For example, in an embodiment of the present disclosure, the attachment mechanisms 150 may comprise a plurality of interlocking components. As a particular example shown in FIG. 2, the attachment mechanisms 150 may comprise interlocking rebar/socket 155. In some embodiments, the rebar 155 may be formed from a plastic material. Using plastic to form the rebar 155 may be advantageous because plastic rebar is cost-effective, non-corrosive, and readily adheres to the concrete used to form the plurality of slabs. In other embodiments, the rebar 155 may be formed from different materials, such as carbon steel, stainless steel, composite formed from glass fiber, carbon fiber, and/or basalt fiber, and/or any other material useful for strengthening and reinforcing the concrete. The rebar 155 may include protruding and naked ends 156, extending outward from a vertical slab (e.g., the side walls 120, the center support mechanism 140, as shown in FIG. 2). In embodiments, sockets 157 for receiving the protruding ends 156 of the rebar 155 may be formed in another slab, of the plurality of slabs (e.g., the base slab 130, as shown in FIG. 2). Other embodiments of the present disclosure may configure the plurality of interlocking components using different geometries such as cubes, ridges, or other interlocking geometries. In still other embodiments, the attachment mechanisms 150 may include non-interlocking geometries. For example, the attachment mechanisms 150 may include one or more chemical adhesives, one or more welded joints, and/or the like. In some embodiments of the present disclosure, the attachment mechanisms 150 may be assembled independently of the plurality of slabs, the plurality of attachment mechanisms 150, may therefore be used to connect a first and a second slab of the plurality of slabs to create the attachment mechanism 150. In further embodiments of the present disclosure. The attachment mechanism 150 may comprise additional cement, concrete, or additional reinforcement material to ensure the plurality of slabs remain in the assembled state 100 once the plurality of attachment mechanism 150 have been secured.

Figure 3:
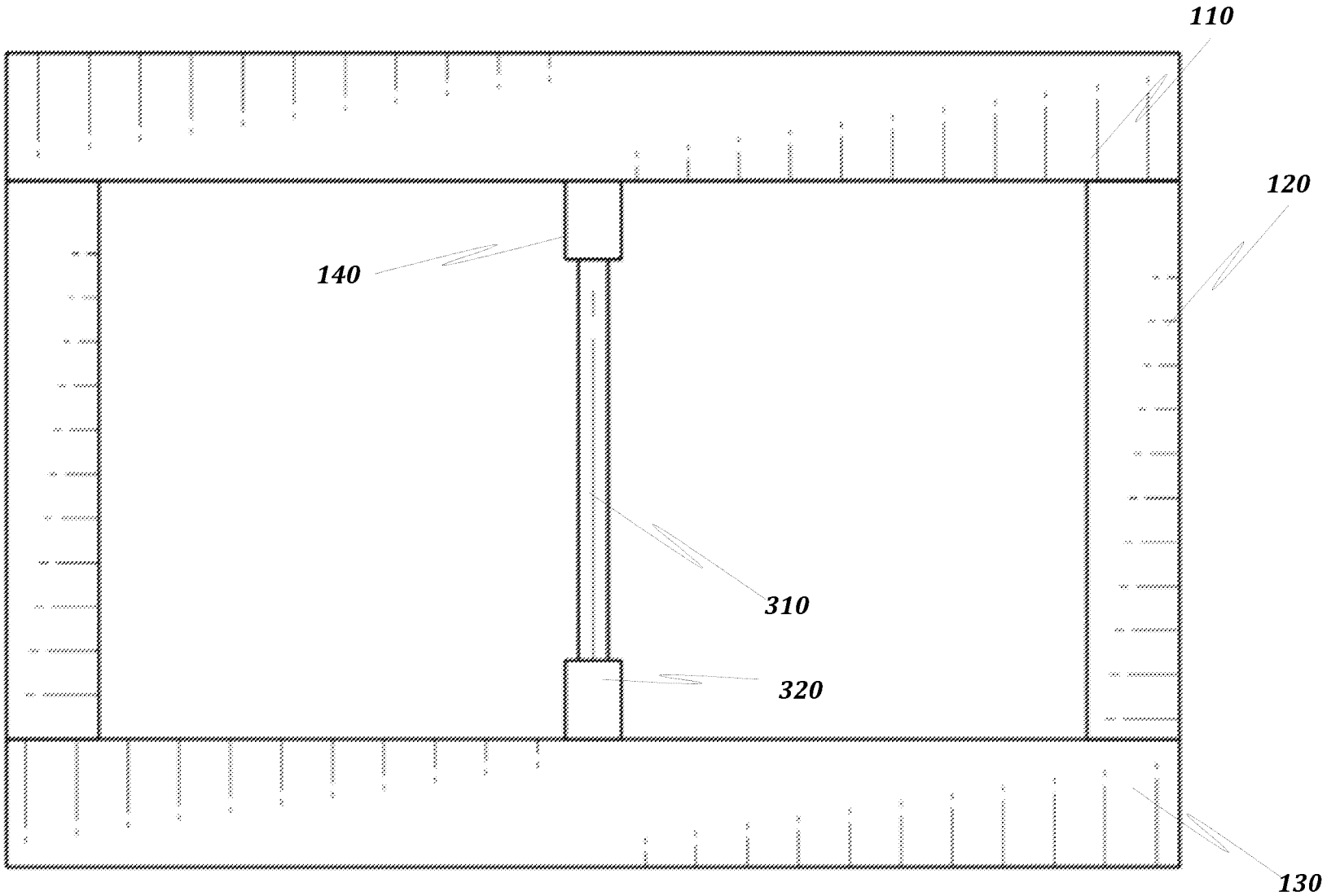
FIG. 3 is a side perspective view of at Storm Water and Traffic Collector Box Culvert.

FIG. 3 illustrates a side perspective view of one possible assembled configuration of the system 100. As illustrated, the system 100 may comprise a plurality of slabs 110, 120, 130 and a center support mechanism 140 to ensure the desired structural integrity of the system. For example, system 100 may be assembled into a plurality of different shapes to drain the runoff such as a polyhedral culvert or other three-dimensional shape.

As shown in FIG. 2, the center support mechanism 140 may comprise a plurality of the attachment mechanisms 150, configured to interconnect the plurality of slabs such as the interlocking rebar 155. As discussed above, the rebar 155 may be formed using a variety of materials, including plastic, carbon steel, stainless steel, composite formed from glass fiber, carbon fiber, and/or basalt fiber, and/or any other material useful for strengthening and reinforcing the concrete. The rebar 155 may include a plurality of protruding and naked ends 156, extending outward from the interlocking rebar 155. In embodiments, one or more (e.g., each) of the plurality of slabs may also include one or more sockets 157 for receiving the protruding ends 156 of the rebar 155. The center support mechanism 140 may comprise a plurality of vertical supports (also known as "columns") 310. In some embodiments, as shown in FIG. 3, the vertical supports may be disposed between a pair of beams 320, including a first beam 140 in contact with the upper slab 110 and a second beam 320 in contact with the base slab 130. The plurality of vertical supports 310 may be formed using materials to adequately support the upper slab 110 and the forces applied to the upper slab 110 as the reinforced surface 115 is under load. In some embodiments of the present disclosure, the plurality of beams 320 and the vertical supports 310 that make up the center support mechanism 140 are constructed and/or formed independently, enabling the modular replacement of a vertical support 310 and/or beam 320 when the system is in the assembled state. In other embodiments, the center support mechanism 140 may comprise the center supports 310 and the beam 320, formed as a monolithic unit. In some embodiments of the present disclosure, the vertical supports 310 and the beams 320 cause little or no restriction to the flow of the runoff accumulated by the system 100. In some embodiments of the present disclosure, the center support mechanism 140 includes a vertical support 310, formed in any of a plurality of different shapes and/or from any of a variety of different materials. For example, the vertical supports 310 and/or the beams 320 may be constructed using a mesh, webbing, and/or other interlaced reinforcement structures that do not interfere with the collection of runoff from the upper slab 110. As another example, the center support mechanism 140, when viewed from above, may have an arcuate or serpentine shape to avoid interfering with the drainage mechanisms 145.

Figure 4:
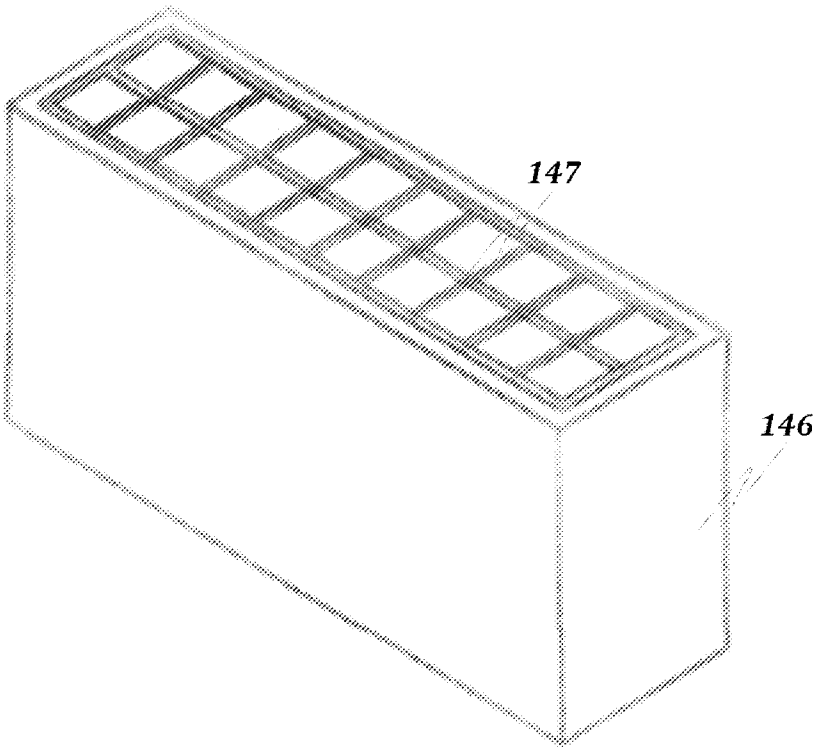
FIG. 4 is a perspective view of a cage for use in a drainage drop inlet.

FIG. 4 illustrates a perspective view of one of the plurality of drainage mechanisms 145, disposed within the upper slab 110. As illustrated, each of the plurality of drainage mechanisms 145 comprises a cage 146 and a grate 147 that defines a plurality of channels or holes to allow for runoff from the top portion (e.g., the reinforced surface 115) of the upper slab 110 to drain into the volume defined by the plurality of slabs. In embodiments, the channels or holes defined by the grate 147 may be sized to help prevent clogging with debris from the runoff, and to avoid impeding traffic on the reinforced surface (e.g., having holes sized to allow foot traffic, automobiles, bicycles, or other traffic to pass over the grate without getting stuck therein). Each of the plurality of drainage mechanisms 145 may be constructed from metals, plastics, and/or other materials that can support the weight of a car or other vehicle using the reinforced surface 115 and be subjected to the environment of the reinforced surface. According to some embodiments of the present disclosure, the plurality of drainage mechanisms 145 may comprise different grate designs according to the structural and environmental needs of the system. For example, a grate design used in conjunction with a reinforced surface 115 formed as a sidewalk may be different from a grate design used in conjunction with a reinforced surface used as a street. In some embodiments of the present disclosure, the plurality of drainage mechanisms 145 may be integrated into the upper slab 110. In other embodiments, the plurality of drainage mechanisms 145 may be formed separately from the upper slab 110 and be added to the upper slab after the upper slab has been constructed. Accordingly, the plurality of drainage mechanisms 145 may be independently replaced as necessary to help the system maximize drainage of runoff from the upper slab 110

Figure 5:
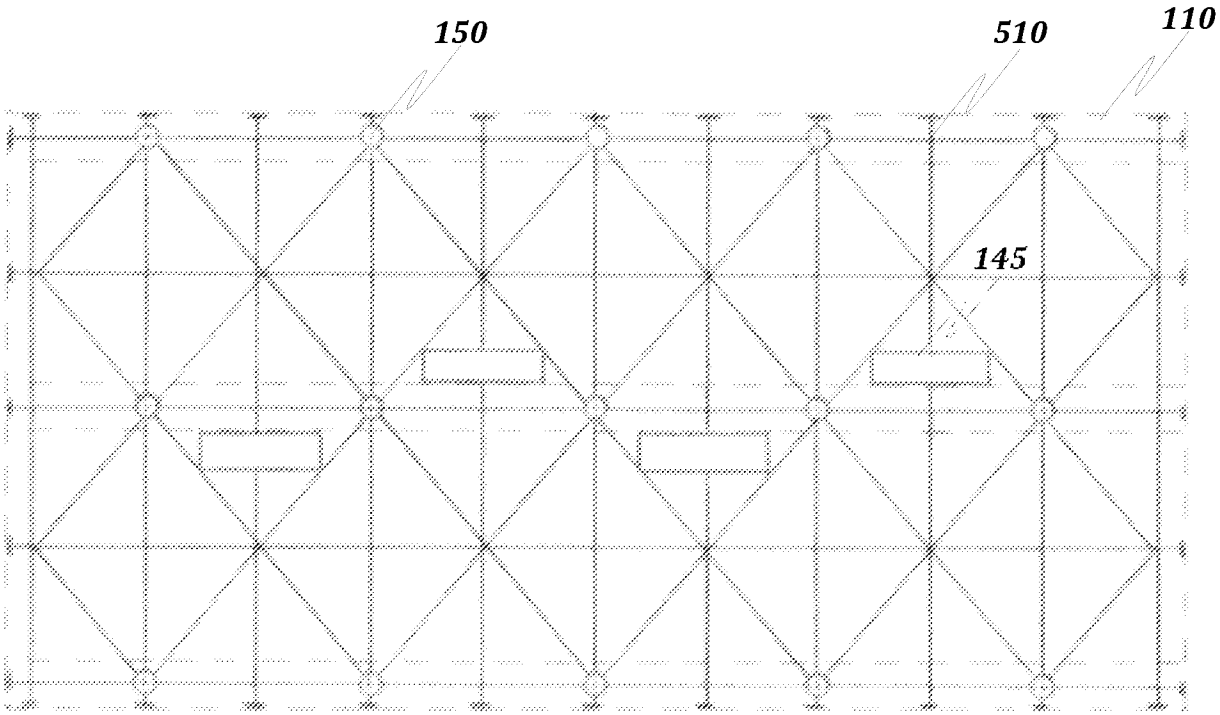
FIG. 5 is a cutaway view of the upper slab.

As discussed previously, the upper slab 110 may include reinforcements to help support the upper slab. FIG. 5 shows a cross-section of the upper slab 110, illustrating a first possible reinforcement diagram showing a plurality of reinforcement materials 510 embedded in the upper slab in a first pattern. For example, the first pattern of reinforcement materials 510 shown in FIG. 5 may be used for an upper slab 110 of an embodiment of the present disclosure comprising a relatively deep culvert. As illustrated, the upper slab 110 comprises the plurality of drainage mechanisms 145, a plurality of attachment mechanisms 150, and the reinforcement materials 510. As shown in FIG. 5, the plurality of drainage mechanisms 145 may pass through the entirety of the upper slab 110 to allow runoff to drain from the reinforced surface of the upper slab into the volume defined by the plurality of slabs (e.g., the upper slab 110, the side walls 120, and the base slab 130) in the assembled state. The plurality of attachment mechanisms 150 may be distributed along the edges of the upper slab 110 (e.g., for connection to the plurality of side walls 120) and may also be distributed along the centerline of the upper slab 110 (e.g., for connection to the center support mechanism 140). Accordingly, the upper slab 110 may be configured to attach to a plurality of other reinforced slabs to create a storm water and traffic box culvert to accumulate runoff. In some embodiments of the present disclosure the upper slab 110 may be configured to accumulate storm water runoff. The reinforcement materials 510 may be formed using one or more of a plurality of different materials such as metals, plastics, ceramics, and/or other materials that can be used to reinforce the plurality of slabs to support the weight of the upper slab 110 and the forces associated with a reinforced surface 115. One particular example of the reinforcement materials 510 is a steel reinforcing rod in the concrete, known as rebar.

FIG. 5 illustrates one possible pattern of distribution for the reinforcement mechanisms 510 within the upper slab. However, the plurality of reinforcement materials 510 may be distributed in various patterns according to the environment where the system is deployed, the traffic patterns on the slab 110, the materials used to form the upper slab, and/or various other considerations. Further, as shown in the drawings, the reinforcement materials 510 and the plurality of drains 145 are distributed at least in a semi repetitive pattern, enabling the system to be designed and constructed in a modular fashion. This helps to allow for the construction of the plurality of slabs to occur off-site. Thereafter, the plurality of preconstructed slabs may be interconnected into a desired configuration on-site. In other embodiments of the present disclosure, all construction and assembly of the system can be performed at the location that the system will be deployed according to the specified dimensions necessary for the system.

Figure 6:
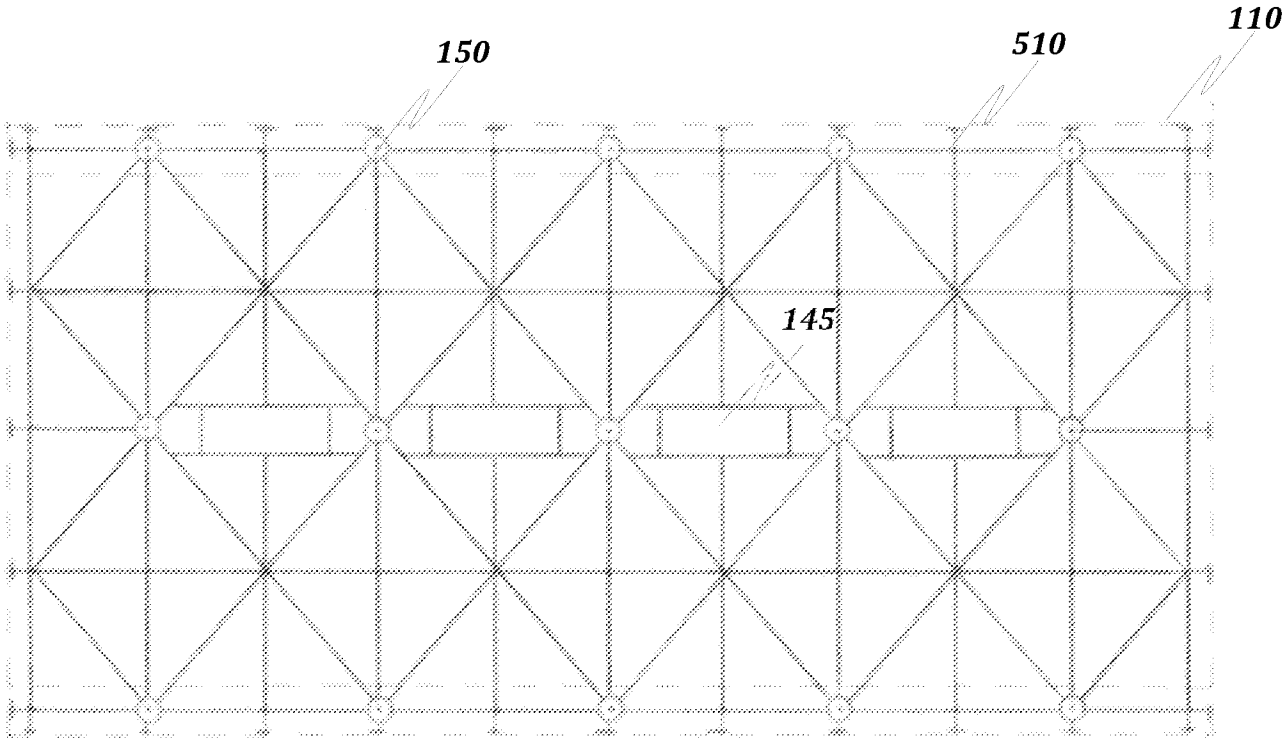
FIG. 6 is a cutaway view of an additional embodiment of the upper slab.

FIG. 6 shows a cross-section of the upper slab 110, illustrating a second possible reinforcement diagram showing a plurality of reinforcement materials 510 embedded in the upper slab in a second pattern. For example, the second pattern of reinforcement materials 510 shown in FIG. 6 may be used for an upper slab 110 of an embodiment according to the present disclosure comprising a relatively shallow culvert. As shown in FIG. 6, the upper slab 110 comprises a plurality of drains 145 distributed along the centerline of the upper slab 110. The reinforcement materials 510 may be distributed to allow for the center support mechanism 140 to attach along the centerline of the upper slab 110, without interfering with the runoff accumulated by the upper slab 110. While FIG. 6 illustrates a second pattern of reinforcement materials 510 embedded in the upper slab 110, the plurality of reinforcement materials 510 may be distributed in various other patterns according to the environment where the system is deployed, the traffic patterns on the slab 110, the materials used to form the upper slab, and/or various other considerations.

Figure 7:
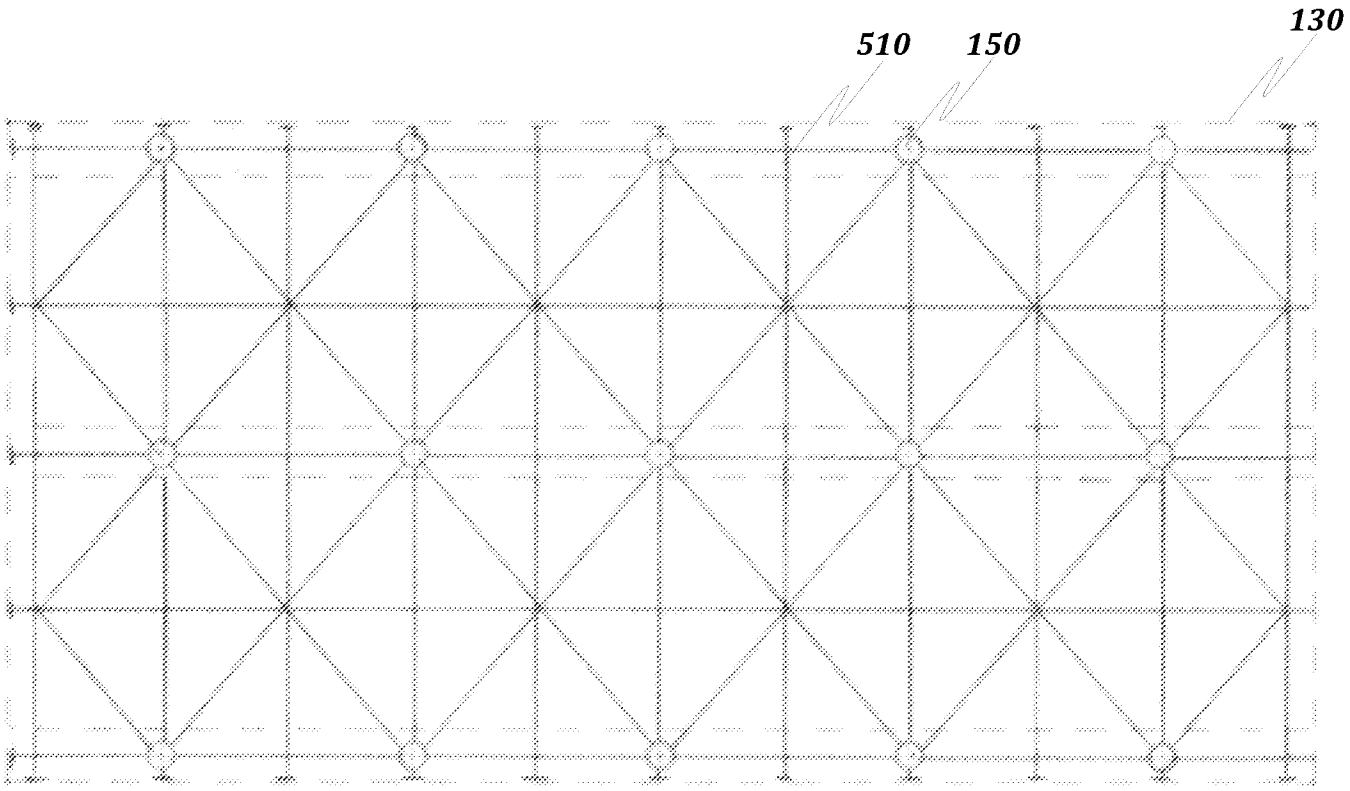
FIG. 7 is a cutaway view of the bottom slab.

FIG. 7 shows a cross-section of the base slab 130, illustrating a possible reinforcement diagram showing a plurality of reinforcement materials 510, embedded in the base slab in a distribution pattern. As illustrated, the base slab 130 may comprise a plurality of reinforcement materials 510 and a plurality of attachment mechanisms 150. The plurality of attachment mechanisms 150 may be distributed throughout the base slab. For example, the center support mechanism 140 may attach to the base slab 130 at the centerline of the base slab 130. Accordingly, a plurality of attachment mechanisms 150 may be distributed along the centerline of the base slab 130, and the reference line to centerline of the vertical walls to facilitate interconnection between the base slab and the center support mechanism 140, consisting a plurality of beams 320, and a plurality of columns 310. As another example, the first and second sidewalls 120 may attach to the base slab 130 along opposing edges of the base slab. Accordingly, a plurality of attachment mechanisms 150 may be distributed along opposing edges of the base slab 130 to facilitate interconnection between the base slab and the first and second side walls 120. While FIG. 7 demonstrates one possible distribution of the reinforcement materials 510, the reinforcement materials may be distributed in various other patterns according to the environment where the system is deployed, the materials used to form the base slab 130, and/or various other considerations.

Figure 8:
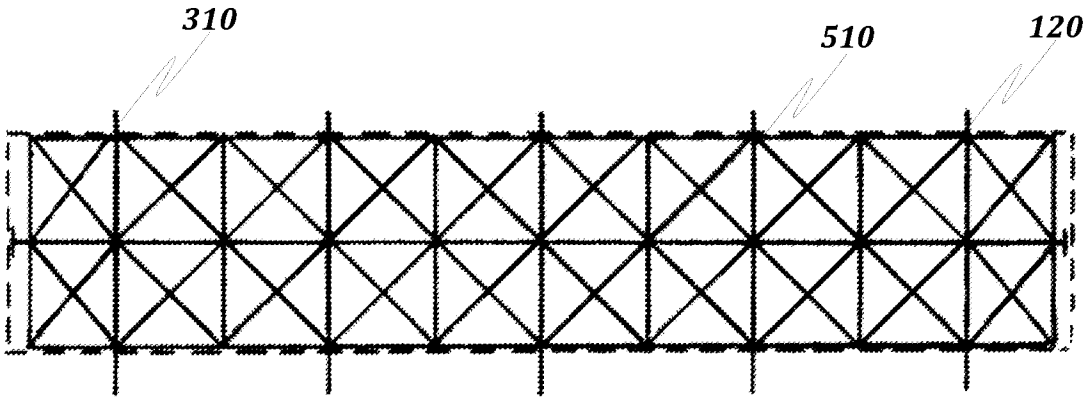
FIG. 8 is a cutaway view showing a possible reinforcement structure of the plurality of sidewalls.

FIG. 8 shows a cross-section of a side wall 120, illustrating a plurality of reinforcement materials 510, embedded in the side wall in a distribution pattern. As illustrated in FIG. 8, each of the plurality of side walls 120 utilizes a modular pattern of reinforcement materials 510 to allow for any size configuration of the system. Further, each of the plurality of side walls 120 may comprise a plurality of attachment mechanisms 150 to interconnect the side wall 120 to the upper slab 110 and/or the base slab 130.

Figure 9:
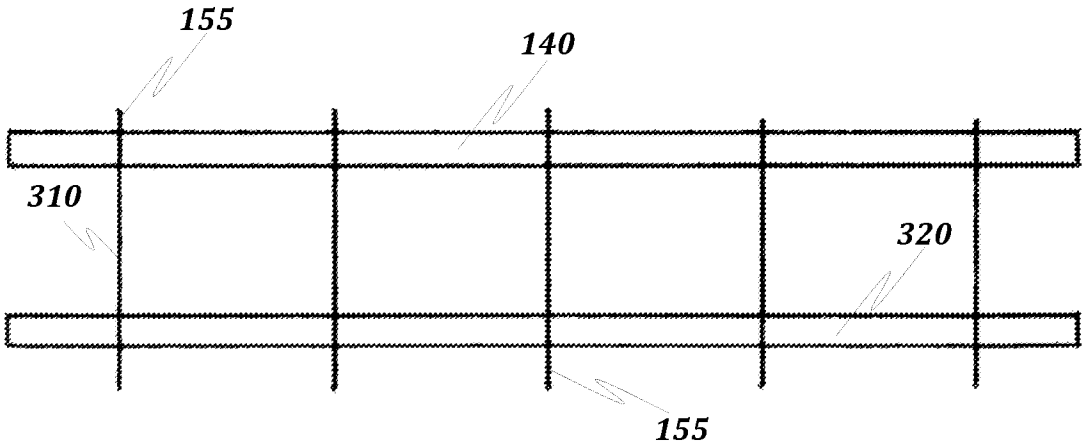
FIG. 9 is a cutaway view showing a possible arrangement of the center support mechanism.

FIG. 9 illustrates a side view of a center support mechanism 140. As illustrated in FIG. 8, the center support mechanism 140 may be constructed with a plurality of attachment mechanisms 150, a plurality of vertical support mechanisms 310, and a plurality of beams 320 extending horizontally across at least a subsection of the center support mechanism.

III. EXAMPLE EMBODIMENT

In one example embodiment of the system, the Box Culvert has a 4 foot tall chamber, covered by the upper slab. The upper slab may comprise four storm water openings, intended for the Drop Inlets, covered by the grates. The storm water openings are offset along a center line of the upper slab, at either side of the upper supporting beam underneath the upper slab. A bottom slab or base slab serves as a base for two identical side walls to further define the culvert. In addition, on a central portion of the bottom slab, the centerline structure is based, consisting of five columns, supported by the bottom beam. The reinforced surface is sloped inward 0.5-1% towards the Drop Inlets, maintaining the reversed crown.

The two identical side walls may have, embedded therein, five columns each, which is determined by the overall length of the upper slab. The naked ends of the columns, constitute around ¾ of the corresponding slab's thickness in length. The sockets may be placed on corresponding slabs, to receive the naked, ends of columns. The centerline structure (e.g., a central support mechanism) is assembled out of five columns, determined by the overall size of the system and upper and lower enforcing beams.

In another example embodiment, the Box Culvert may have a height of two feet, and may include a plastic reinforcing carcass within the upper slab of the Box Culvert. The Box culvert may include five vertical columns along a center line, extending between a base slab and the upper slab. As there is no supporting beam, four cages for the storm water openings for Drop Inlets, are lined up along the centerline of the carcass. The reinforcing carcass may comprise fifteen circles, outlining the sockets.

The circles may identify the vertical pipes of a little larger than columns' diameter. At the upper slab that pipes' length may constitute ½-¾ of the slab's thickness, and at the lower slab those pipes' length may constitute ¾ to a full thickness of the slab, such that they may match the lengths of the upper and lower protruding ends of the columns respectively. Those pipes may receive the protruding ends of the columns, acting similarly to the pair "piston—cylinder". This addition may ensure the better fitness of the Box Culvert while its assembled, and may also enable better precision of Box Culvert during the assembly process. The better structural integrity of the Box also may be achieved as the moving parts, while assembling, may be limited only to the plastic material. Additionally, the construction of the Box Culvert may allow for the possibility of disassembly of the system without damage.

IV. CLAIMS

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as examples for embodiments of the disclosure.

Insofar as the description above and the accompanying drawing disclose any additional subject matter that is not within the scope of the claims below, the disclosures are not dedicated to the public and the right to file one or more applications to claims such additional disclosures is reserved.

The following is claimed:

1. A system for a storm water and traffic collector box culvert, the system comprising:

an upper slab comprising a reinforced surface, a plurality of grated cages, and a plurality of upper slab attachment mechanisms;

wherein the reinforced surface is sloped to direct runoff towards the plurality of grated cages;

wherein the reinforced surface comprises a plurality of drainage mechanisms alternating along the centerline of the reinforced surface configured to retain the plurality of grated cages and to drain the runoff collected by the reinforced surface;

wherein a first subset of the plurality of upper slab attachment mechanisms is distributed along a first edge of the upper slab, a second subset of the plurality of upper slab attachment mechanisms is distributed along a second edge of the upper slab, and a third subset of the plurality of upper slab attachment mechanisms is distributed along a centerline of the upper slab;

a base slab comprising a plurality of base slab attachment mechanisms, wherein a first subset of the plurality of base slab attachment mechanisms is distributed along a first edge of the base slab, a second subset of the plurality of base slab attachment mechanisms is distributed along a second edge of the base slab, and a third subset of the plurality of base slab attachment mechanisms is distributed along a centerline of the base slab;

a first side wall comprising a plurality of first side wall attachment mechanisms, wherein a first subset of the first side wall attachment mechanisms is configured to mate with the first subset of upper slab attachment mechanisms and a second subset of the first side wall attachment mechanisms is configured to mate with the first subset of base slab attachment mechanisms to secure to the first side wall to the upper slab and the base slab;

a second side wall comprising a plurality of second side wall attachment mechanisms, wherein a first subset of the second side wall attachment mechanisms is configured to mate with the second subset of upper slab attachment mechanisms and a second subset of the second side wall attachment mechanisms is configured to mate with the second subset of base slab attachment mechanisms to secure to the second side wall to the upper slab and the base slab, wherein the first side wall and the second side wall are parallel to the drainage mechanisms that alternate along the centerline of the reinforced surface; and a center support mechanism comprising an upper support beam and a lower support beam separated by a plurality of vertical support columns, wherein the upper support beam is configured to mate with the third subset of the plurality of upper slab attachment mechanisms, the lower support beam is configured to mate with the third subset of the plurality of base slab attachment mechanisms, wherein the center support mechanism extends along the centerline of the reinforced surface, and does not interfere with the plurality of drainage mechanisms that alternate along the centerline of the reinforced surface;

wherein the upper slab, the base slab, the first side wall, the second side wall, and the center support mechanism form a polyhedral culvert configured to drain the runoff supported by the center support mechanism.

2. The system of claim 1, wherein at least one of the upper slab, the base slab, the fist side wall, the second side wall, and the center support mechanism is reinforced by a plurality of metallic, plastic, or ceramic materials.

3. The system of claim 1, wherein the polyhedral culvert comprises a rectangular prism.

4. The system of claim 1, wherein the center support mechanism is located half-way between the first side wall and the second side wall.

5. The system of claim 1, wherein a weight of the upper slab secures the upper slab to the first side wall, the second side wall, and the center support mechanism.

6. A storm water runoff and culvert system, comprising:

a plurality of reinforced concrete slabs assembled to define a polyhedral shape supported by a support mechanism;

wherein a first slab, of the plurality of reinforced concrete slabs, includes a reinforced surface having a plurality of drainage mechanisms to allow runoff to pass through the first slab at the location of the plurality of drainage mechanisms, and wherein the reinforced surface includes a reversed crown to direct the runoff towards a center line of the reinforced surface;

wherein a second slab, of the plurality of reinforced concrete slabs, is configured to oppose the first slab, and wherein the runoff is collected between the first slab and the second slab;

wherein at least one third slab, of the plurality of reinforced concrete slabs, is configured to interconnect with the first slab and the second slab via one or more attachment mechanisms, to form said support mechanism and to support at least the first slab, and wherein the support attachment mechanism extends along a centerline of the first slab, and does not interfere with the plurality of drainage mechanisms.

7. The system of claim 6, wherein the plurality of reinforced concrete slabs is reinforced by a plurality of metallic, plastic, or ceramic materials.

8. The system of claim 6, wherein the plurality of reinforced concrete slabs is assembled to define a rectangular prism, and wherein the one or more attachment mechanisms are oriented to support a center of the first slab.

9. The system of claim 6, wherein the plurality of reinforced concrete slabs are configured to allow the runoff to escape through the plurality of reinforced concrete slabs at a rate that a surrounding environment can absorb.

10. The system of claim 6, wherein the plurality of drainage mechanisms comprise a plurality of drains, grates, or pipes.

11. The system of claim 6, wherein the one or more attachment mechanisms are configured to allow at least some of the runoff to exit the system at a rate that a surrounding environment can absorb.

12. The system of claim 6, wherein a weight of the plurality of reinforced concrete slabs secures the plurality of reinforced concrete slabs using the one or more attachment mechanisms.

13. A system for storm water runoff and traffic collection, the system comprising:

a plurality of interconnected reinforced concrete slabs, each slab, of the plurality of interconnected reinforced concrete slabs, comprising:

a slab connection mechanism configured to connect the slab to at least one other slab, of the plurality of interconnected reinforced concrete slabs, wherein the slab connection mechanism is configured to allow some runoff to drain allowing runoff to pass through the slab connection mechanism where the plurality of reinforced concrete slabs interconnect; and a support attachment mechanism comprising a plurality of reinforced columns spaced between two parallel support connection beams, the support attachment mechanism configured to support at least one slab, of the plurality of interconnected reinforced concrete slabs;

wherein at least one of the plurality of interconnected reinforced concrete slabs is configured with at least one drainage mechanism, the at least one slab configured with the at least one drainage mechanism constructed to direct the runoff towards the corresponding at least one drainage mechanism, wherein the at least one drainage mechanism drains water through the interconnected reinforced concrete slab without interfering with the support attachment mechanism.

14. The system of claim 13, wherein the plurality of interconnected reinforced concrete slabs is reinforced by a plurality of metallic, plastic, or ceramic materials.

15. The system of claim 13, wherein the at least one drainage mechanism is disposed along a centerline of a corresponding one of the plurality of interconnected reinforced concrete slabs.

16. The system of claim 13, each slab connection mechanism is configured to secure the slab in a particular orientation relative to at least one other slab, of the plurality of interconnected reinforced concrete slabs.

17. The system of claim 13, wherein the at least one of the plurality of interconnected reinforced concrete slabs configured to direct the runoff towards the at least one drainage mechanism has a reversed crown to direct the runoff toward a centerline of the slab.

18. The system of claim 13, wherein the plurality of interconnected reinforced concrete slabs is configured as a culvert to collect and drain the runoff collected by at least one of the slabs.

19. The system of claim 13, wherein the system is configured to connect to existing storm drains.

* * * * *